US010442667B2

(12) United States Patent
Hokanson

(10) Patent No.: US 10,442,667 B2
(45) Date of Patent: Oct. 15, 2019

(54) FORKLIFT FORK GRABBER MECHANSIM FOR SECURING ATTACHMENTS TO FORKLIFT FORKS

(71) Applicant: Craig Richard Hokanson, Clearfield, UT (US)

(72) Inventor: Craig Richard Hokanson, Clearfield, UT (US)

( * ) Notice: Subject to any disclaimer, the term of this patent is extended or adjusted under 35 U.S.C. 154(b) by 0 days.

(21) Appl. No.: 15/263,340

(22) Filed: Sep. 12, 2016

(65) Prior Publication Data

US 2018/0072547 A1 Mar. 15, 2018

(51) Int. Cl.
*B66F 9/18* (2006.01)

(52) U.S. Cl.
CPC ..... *B66F 9/183* (2013.01)

(58) Field of Classification Search
CPC ..... B66F 9/183; B66F 9/07504; B66F 9/18; B66F 9/061; B66F 9/075
USPC ..... 414/607
See application file for complete search history.

(56) References Cited

U.S. PATENT DOCUMENTS 3,410,431 A * 11/1968 Vik ..... B66F 9/184 294/206
5,560,129 A * 10/1996 Rothbart ..... B66F 9/12 37/231
2007/0065266 A1* 3/2007 Pax ..... B66F 9/12 414/655

* cited by examiner

*Primary Examiner* — Glenn F Myers
(74) *Attorney, Agent, or Firm* — Steven Rinchart

(57) ABSTRACT

A forklift fork grabber mechanism is provided for clamping forks to a load by applying tensile or compressive force between a forklift attachment and the forks using a binder, bolts, motor, latch, or other means.

4 Claims, 7 Drawing Sheets

FORKLIFT FORK GRABBER MECHANSIM FOR SECURING ATTACHMENTS TO FORKLIFT FORKS

BACKGROUND OF THE INVENTION

Field of the Invention

This invention relates to apparati for securing forklift attachments to forklift forks, and more particularly relates to the use of mechanisms to apply pressure to the side of the fork(s) which forces the fork to bind against the fork attachment, achieving a positive securement.

Description of the Related Art

Forklifts and their accompanying fork accessories are well-known in the art. Typically, the forklift is a powered industrial truck used to lift and move materials short distances using variety of detachable forklift attachments which are supported by the forklift forks. Forklift attachments vary in weights and dimensions. Forklift attachments are used for different material handling and moving loads in specific positions. Forklift attachments often have pockets where the forklift forks will be placed within as a way of lifting the attachment and its purpose built load safely. Different forklift attachments are designed with different ways for the forks to be positioned within the attachment.

Forklift operators, OSHA, The Army Corp of Engineers, forklift attachment manufactures, forklift manufactures, and many other sources, recognize many safety concerns and dangers with the present ways forklift attachments are secured to the forklift forks. Because forklift forks are tapered in their vertical thickness from front to rear with the front thinner than the rear, forklift attachments move or slide on the fork becoming looser as they move forward toward the front of the forklift forks. Currently to prevent this forklift attachments may have a t-bolt or clamp of some type on the top or bottom of the forks with an additional safety chain to go around the back of the fork. Because the forklift forks flex and bow as a load is applied the top and bottom t bolts or clamps can't retain a constant pressure, requiring a safety chain as a second way of preventing the forklift attachment from sliding off the forklift forks. Safety chains connected behind the forks also present many problems in the industry. Many forklifts have moving parts behind the forks that the safety chains may be damaged by. Many operators install the safety chain wrong or loosely. Damaged or loose safety chains often break when the attachment slides.

Loose forklift attachments have also been known to cause and increase wear on many of the parts in the forklifts. With this wear comes expensive repairs and maintenance costs.

The need for a stronger mechanical clamp to positively hold forklift attachments to the forks has been a growing safety need for some time. The current problems with traditional clamping methods over or under the forks, is that the forks are tapered and if the clamp slides any distance toward the end of the forks it becomes loose and unsafe. Clamping is required by OSHA and all other safety agencies. Stronger clamps increase safety but the tapered fork in combination with the downward force bending and often bouncing the forks increases the chance for sliding loose.

The purpose for a Forklift Fork Grabber is to increase safety for forklift equipment operators including nearby personnel. It will positively hold attachments to the forklift forks by clamping to sides where the forks do not taper. Additionally, there is a need in the art for a smart electromechanical fork grabber mechanism which can be configured to automatically clamp down upon, engage, or otherwise secure a forklift attachment to one or more forks.

SUMMARY OF THE INVENTION

From the foregoing discussion, it should be apparent that a need exists for a mechanism for securing forklift attachments positively to forklift forks. Beneficially, such an apparatus would overcome many of the difficulties and safety concerns expressed, by providing mechanisms to apply pressure against the side of the fork which forces the other side of the fork to bind against the fork attachment, achieving a positive securement.

The present invention has been developed in response to the problems and needs in the art that have not yet been fully solved by currently available apparati and methods. Accordingly, the present invention has been developed to provide a forklift fork grabber for securing attachments to a forklift, forklift fork grabber comprising: a fork attachment base comprising two fork tubes for receiving forks, each of the fork tubes defining an aperture on an interior surface of the fork tube for facilitating engagement between a fork and the forklift fork grabber; two fulcrum mounts, each of the two fulcrum mounts affixed to an interior surface of a fork tube; a binder for applying tensile force with ratcheting of a handle; two levers, each lever hingedly affixed at a midpoint to a fulcrum mount, each lever hingedly affixed at a proximal end to the binder; and wherein each lever is adapted to apply tensile force at a distal end through an aperture to a fork inserted into a fork tube when the binder is ratcheted such that the fork becomes frictionally bound to the fork attachment base.

The forklift fork grabber may further comprise a tapered engagement protrusion affixed to a distal end of a lever. Each of the fulcrum mounts may be welded to an interior surface of the fork attachment base.

A second forklift fork grabber for securing attachments to a forklift is provided, forklift fork grabber comprising: a fork attachment base comprising two fork tubes for receiving forks, each of the fork tubes defining an aperture on an interior surface of the fork tube for facilitating engagement between a fork and a hydraulically-actuated cylinder; and the hydraulically-actuated cylinder for applying tensile force to the forks.

A method for securing attachments to a forklift, steps of the method comprising: defining an aperture on an inside surface of a fork tube; and applying pressure to a fork within the fork tube. The force may comprise tensile force. The force may comprise compressive force.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Provision of a forklift fork grabbing mechanism is an object of the present invention which can be designed and built in many configurations such as; single or multiple forks clamped with one mechanical device, varying widths or depths, a varying quantity or positions such as forward or back, integrated or added to the attachment. The disclosed apparatus can work at multiple angles ranging from and not limited to 0 degrees to 90 degrees, and a combined variation of all in one design. It can be made of multiple materials including but not limited to metals, alloys, wood, plastics, fiberglass, and composites. The binding mechanism may be comprised of many industrial components currently offered in the industry including, binders, ratchets levers, handles and such. It can use a combination of levers and devices to push or pull clamping the fork to the sides of the fork attachment and or fork tubes. The mechanism may be adjustable allowing for different widths of forks to be clamped in the attachment.

Figure 1:
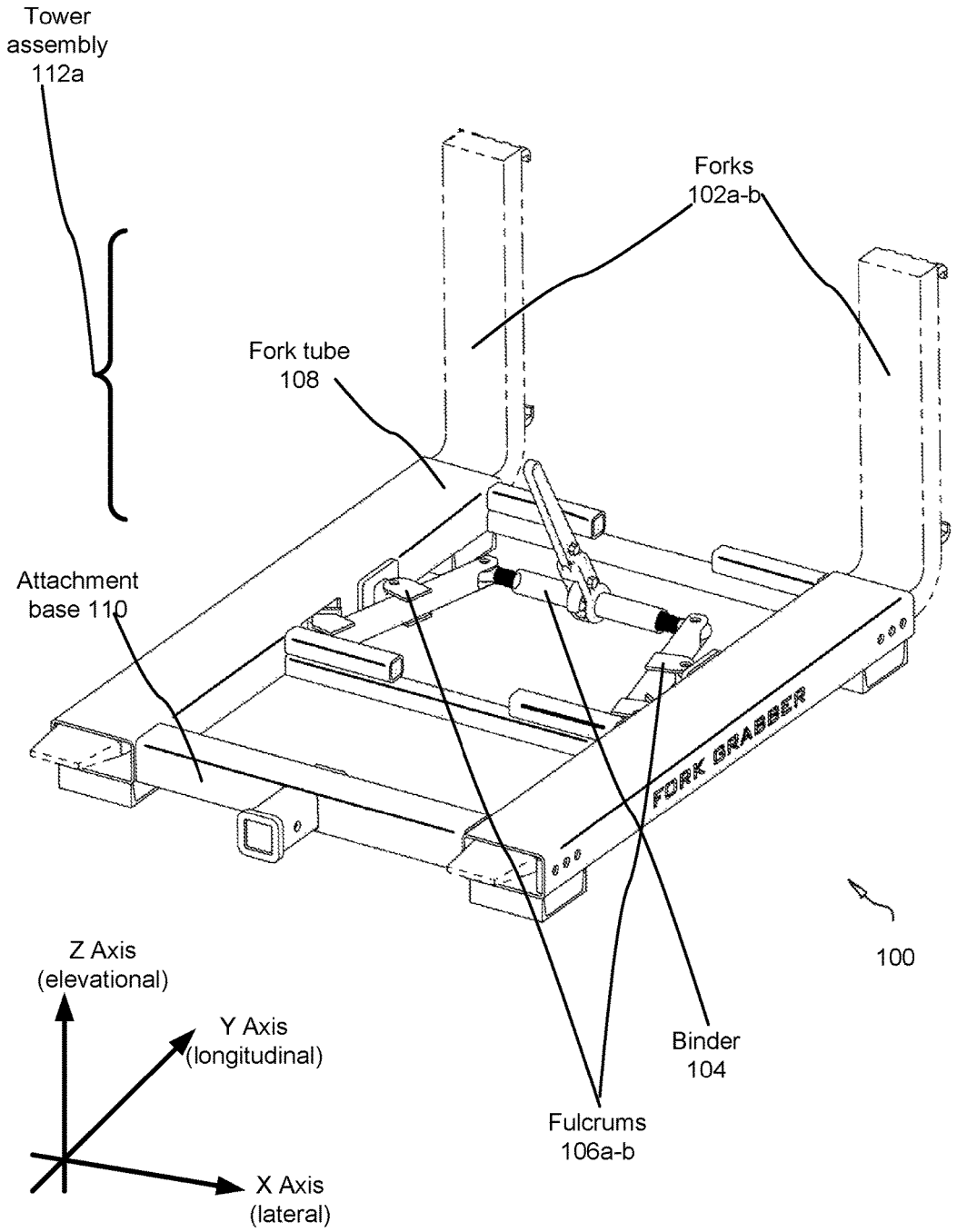
FIG. 1 is an elevational frontal-side perspective view of a forklift fork grabber for securing attachments to forklift forks in accordance with the present invention.

FIG. 1 is an elevational frontal-side perspective view of a forklift fork grabber for securing attachments to forklift forks in accordance with the present invention.

The fork attachment base 110 is accessed by a forklift for inserting or removing a plurality of forks and lifting a load disposed upon or affixed to the fork attachment base 110. Additionally, the fork attachment base 110 may comprise one or more tiers for retaining the forks at different elevations. In this manner, variously sized and dimensioned forks may be used to lift a load.

The fork attachment base 110 comprises multiple members, junctions, and organizational spacing configured to receive and retain two forks as known to those of skill in the art and may be manufactured from a rigid material, including, without limitation, steel, aluminum, magnesium, titanium, metal alloys, polymers, wood, carbon-fiber, carbon fiber, fiberglass, resins, plastics, composites, and other structural materials known in the art.

The fork attachment base 110 comprises two fork tubes 108 for receiving the forks 102 on a forklift. The fork attachment base 110 forms a generally rectangle or quadrilateral from an upper perspective view.

The fork attachment base 110 may include one or more load bearing members that extends horizontally between fork tubes 108.

Each of the components of the apparatus 100 may be welded or bolted together, overlay one another, or may be fastened through various fasteners at a junction. In many embodiments, the components are affixed at right angles (i.e. 90 degree angles) to one another.

In one embodiment, a pair of forks 102 position on opposite fork tubes 108. The forks align in parallel within the fork tubes 108. Furthermore, the multiple load bearing members 108 can be positioned at different elevations on the rack 100, forming multiple tiers of load bearing members 108 to support the forks.

Various components of the apparatus 100 may be comprised of structural components including, without limitation to, rod, bar, angle, square tube, rectangular tube, round tube, channel, pipe, I-beams, plate, and other structural components known in the art including bolts, nuts and other fasteners in some embodiments.

The apparatus 100 comprises a binder 104 disposed and hingedly affixed between two levers affixed at midpoints to a mounting base affixed to an interior surface of a fork tube 108. This binder 104 may be ratcheted with a handle to apply tensile force (or release tensile force) to a fork 102 vis-à-vis a lever.

Figure 2:
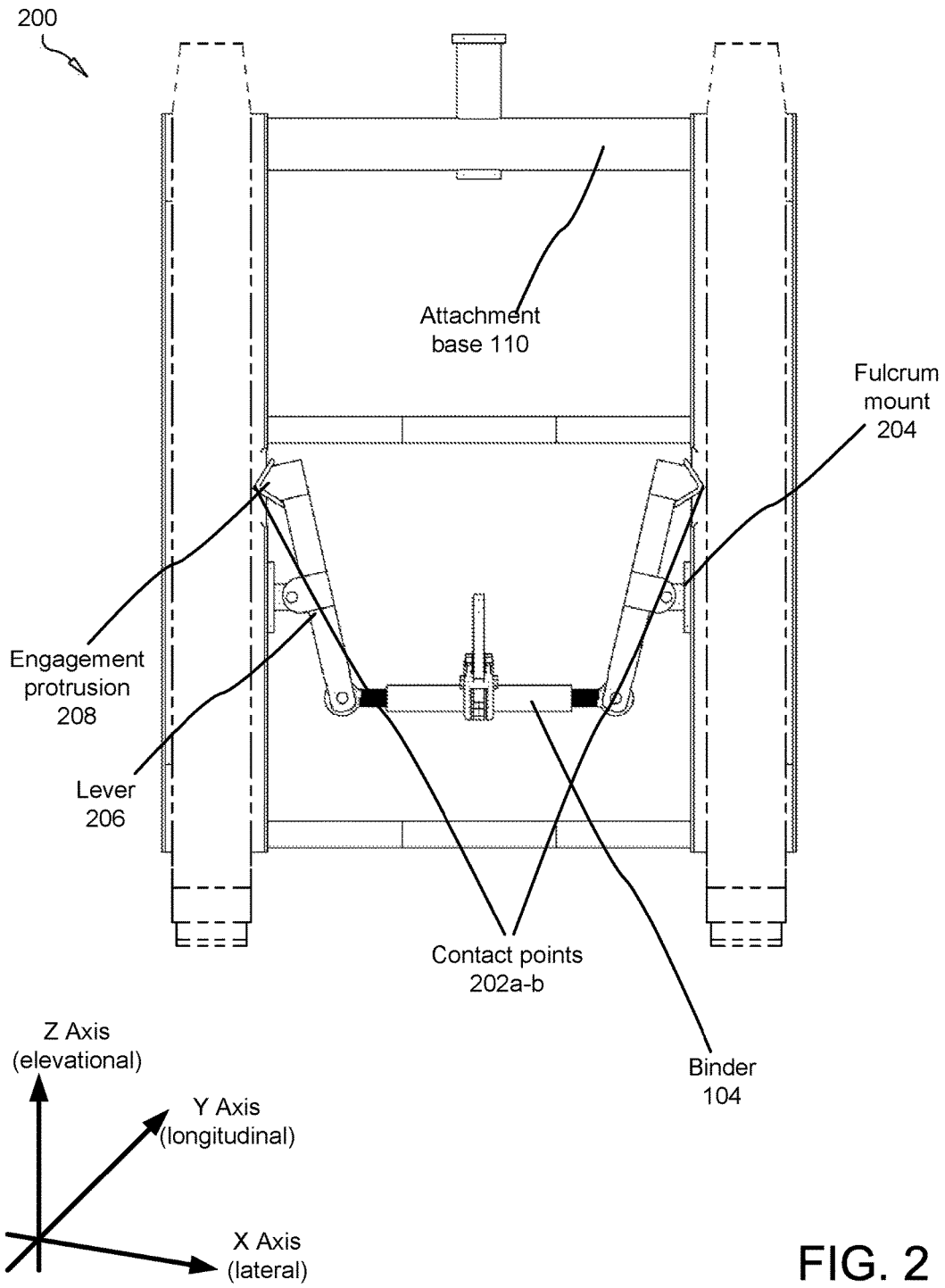
FIG. 2 is a top perspective view of a forklift fork grabber for securing attachments to forklift forks in accordance with the present invention.

FIG. 2 is a top perspective view of a forklift fork grabber 200 for securing attachments to forklift forks in accordance with the present invention. The apparatus 200 is shown in the closed position in FIG. 2 in which tensile force is being applied to the forks 102.

As shown, distal ends of the levers 206 may comprise or be affixed to engagement protrusions 208 which insert through an aperture on the interior surface of the fork tube 108. These engagement protrusions 208, or alternatively the distal ends of the lever 206 in the absence of the engagement protrusions 208, are adapted to apply tensile force to a fork 102 when the binder 104 is ratcheted.

Figure 3:
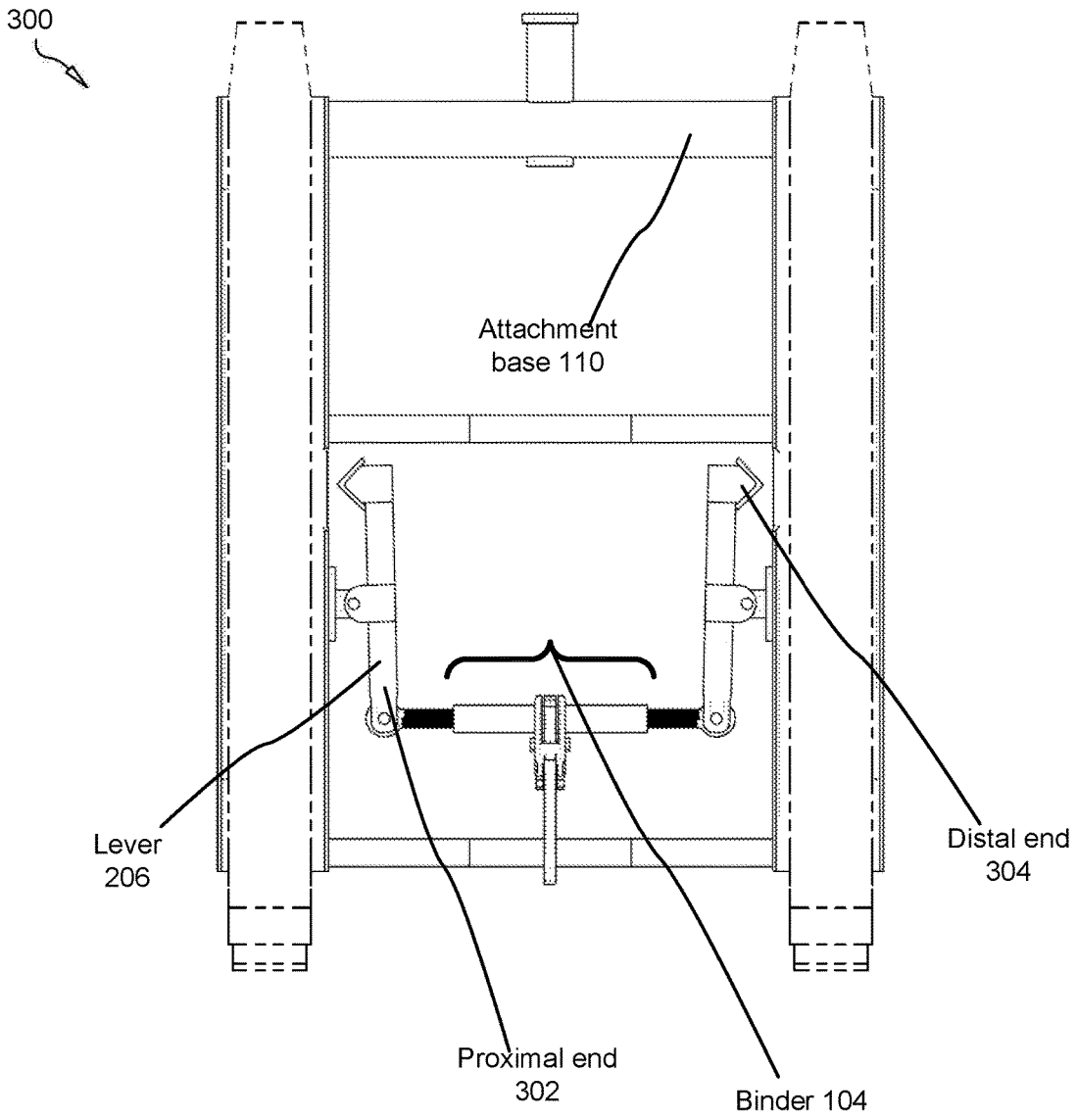
FIG. 3 is a top perspective view of a forklift fork grabber for securing attachments to forklift forks in accordance with the present invention.

FIG. 3 is a top perspective view of a forklift fork grabber for securing attachments to forklift forks 300 in accordance with the present invention. The apparatus 300 is shown in the open position in FIG. 3 in which tensile force is not being applied to the forks 102.

The levers 206 are hingedly affixed to a mounting bracket at a midpoint and also hingedly affixed to the binder 104 at a proximal end.

Figure 4:
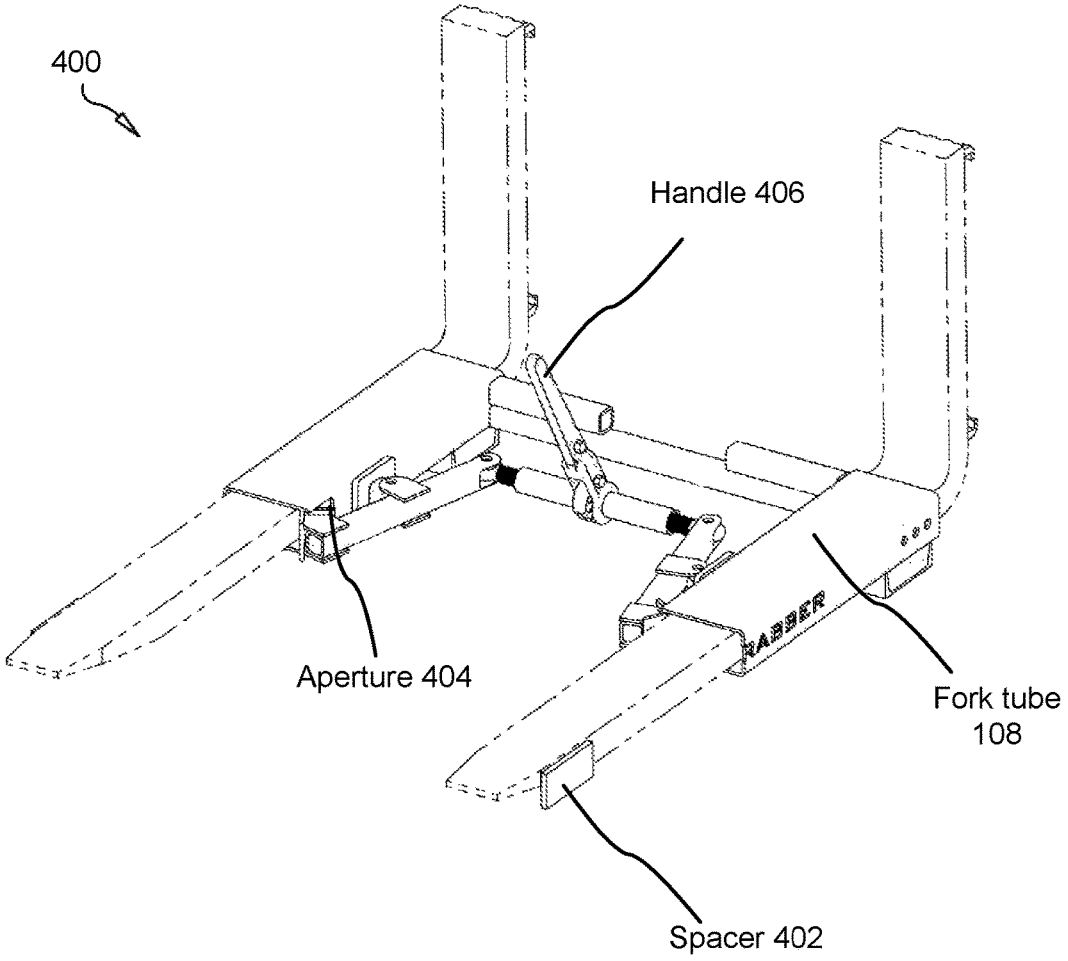
FIG. 4 is an elevational frontal-side perspective view of a forklift fork grabber for securing attachments to forklift forks in accordance with the present invention.

FIG. 4 is an elevational frontal-side perspective view of a forklift fork grabber 400 for securing attachments to forklift forks in accordance with the present invention.

The fork tubes 108 define apertures which may be cut, drilled or otherwise defined in the fork tube 108. These apertures allow force to be applied by a lever 206 to a fork 102 in the fork tube 108, which force binds the fork 102 to an interior recess of the fork tube 108 frictionally, preventing the fork attachment base 110 and a corresponding load from slipping of the forks 102.

Figure 5A:
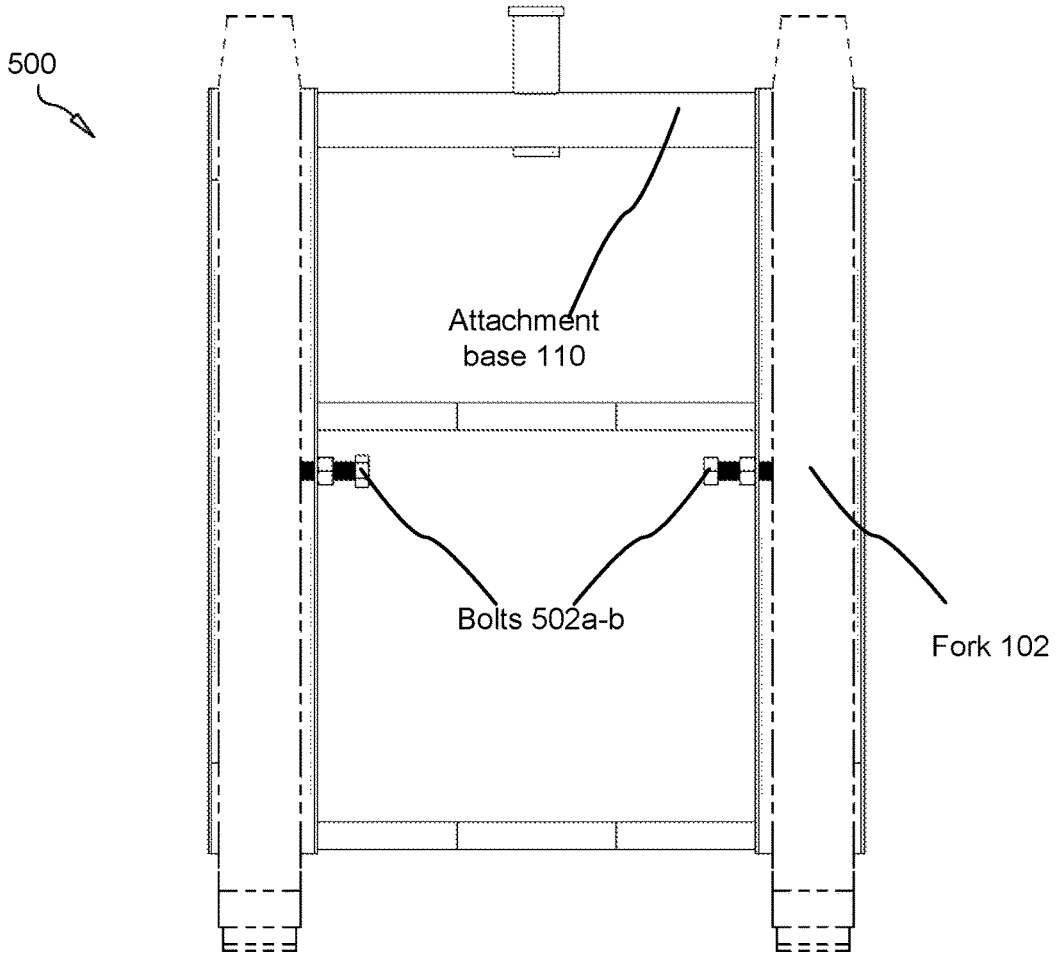
FIG. 5A is a top perspective view of a forklift fork grabber for securing attachments to forklift forks in accordance with the present invention.

FIG. 5A is a top perspective view of a forklift fork grabber 500 for securing attachments to forklift forks in accordance with the present invention.

In alternative embodiments, bolts 502 may insert through threaded holes and engagement a fork 102. The bolts 502 may be used in place of the binder 104 to bind the forks 102 to the fork tubes 108.

Figure 5B:
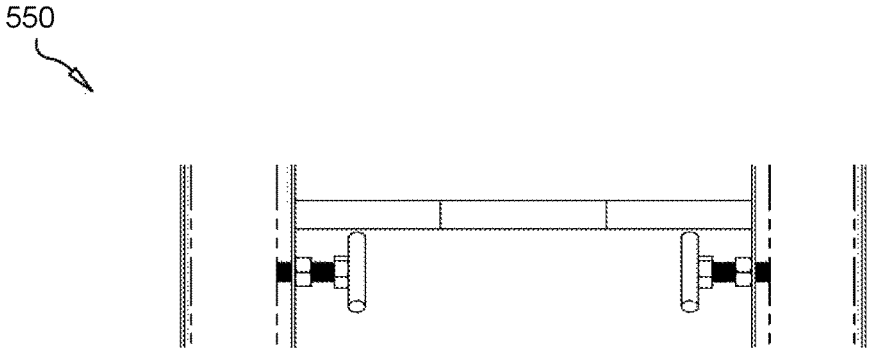
FIG. 5B is a top perspective view of a forklift fork grabber for securing attachments to forklift forks in accordance with the present invention.

FIG. 5B is a top perspective view of a forklift fork grabber 550 for securing attachments to forklift forks in accordance with the present invention. As shown, the bolts 502 may comprise or consist of T-bolts.

Figure 6:
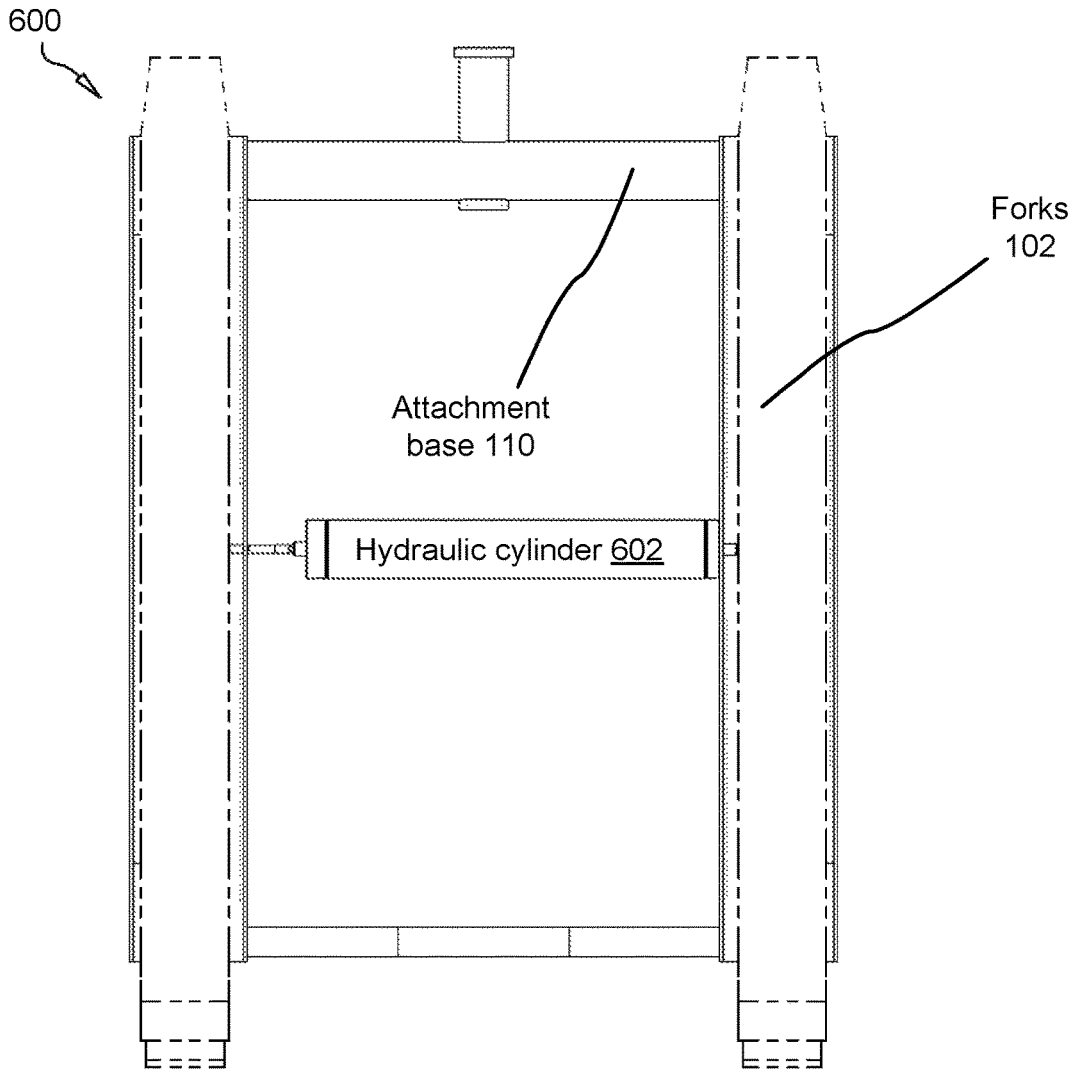
FIG. 6 is a top perspective view of a forklift fork grabber for securing attachments to forklift forks in accordance with the present invention.

FIG. 6 is a top perspective view of a forklift fork grabber 600 for securing attachments to forklift forks in accordance with the present invention.

The apparatus 600 comprises a hydraulic cylinder 602 which may adapted to apply force through the fork tubes 108 to the forks 102. The hydraulic cylinder 602 may be sized and dimensioned to fit between fork tubes 108 in the fork attachment base 110.

Figure 7:
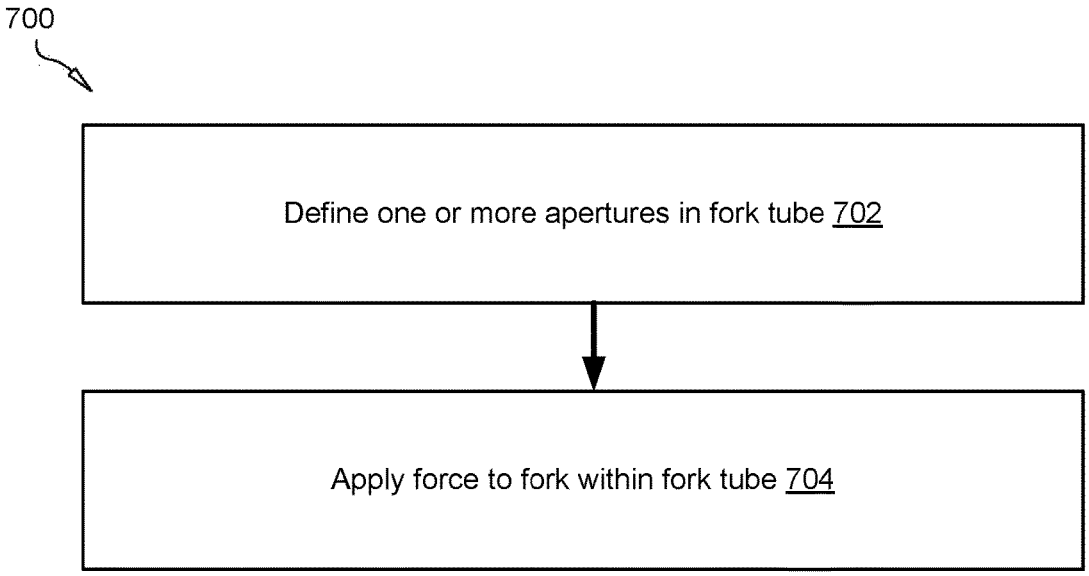
FIG. 7 is a flow chart of a method of securing attachments to forklift forks in accordance with the present invention.

FIG. 7 is a flow chart of a method of securing attachments to forklift forks in accordance with the present invention.

In is an object of the present invention to provide a method of securing a load to a fork by applying pressure to the fork within the fork tube through an aperture in the force tube, which may be cut, drilled, or otherwise defined.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A forklift fork grabber for securing attachments to a forklift comprising:

a fork attachment base comprising two fork tubes for receiving forks, each of the fork tubes defining an aperture on an interior surface of the fork tube which faces an opposing fork tube for facilitating engagement between a fork and the forklift fork grabber;

two fulcrum mounts, each of the two fulcrum mounts affixed to an interior surface of a fork tube of said fork tubes;

a binder for applying tensile force with ratcheting of a handle;

two levers, each lever hingedly affixed at a midpoint to a fulcrum mount of said fulcrum mounts, each lever hingedly affixed at a proximal end to the binder; and wherein each lever is adapted to apply tensile force at a distal end through said aperture to the fork inserted into a fork tube of said fork tubes when the binder is ratcheted such that the fork becomes frictionally bound to the fork attachment base.

2. The forklift fork grabber of claim 1, further comprising a tapered engagement protrusion affixed to a distal end of a lever of said two levers.

3. The forklift fork grabber of claim 1, wherein each of the fulcrum mounts is welded to said interior surface of the fork attachment base.

4. A forklift fork grabber for securing attachments to a forklift comprising:

a fork attachment base comprising two fork tubes for receiving forks, each of the fork tubes defining an aperture on an interior surface facing the opposing fork tube of the fork tube for facilitating engagement between a fork of said forks and a hydraulically-actuated cylinder; and the hydraulically-actuated cylinder for applying tensile force to the forks.

* * * * *